US011268179B2

(12) United States Patent
Mantione et al.

(10) Patent No.: US 11,268,179 B2
(45) **Date of Patent: *Mar. 8, 2022**

(54) CREEP RESISTANT TITANIUM ALLOYS

(71) Applicant: ATI Properties LLC, Albany, OR (US)

(72) Inventors: John V. Mantione, Indian Trail, NC (US); David J. Bryan, Indian Trail, NC (US); Matias Garcia-Avila, Matthews, NC (US)

(73) Assignee: ATI PROPERTIES LLC, Albany, OR (US)

( * ) Notice: Subject to any disclaimer, the term of this patent is extended or adjusted under 35 U.S.C. 154(b) by 321 days.

This patent is subject to a terminal disclaimer.

(21) Appl. No.: 16/114,405

(22) Filed: Aug. 28, 2018

(65) Prior Publication Data

US 2020/0071806 A1 Mar. 5, 2020

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00
See application file for complete search history.

(56) References Cited

U.S. PATENT DOCUMENTS 2,893,864 A 7/1959 Harris et al.
2,918,367 A 12/1959 Crossley et al.
3,131,059 A 4/1964 Kaarlela
3,565,591 A 2/1971 Canonico et al.
3,595,645 A 7/1971 Hunter et al.
3,833,363 A 9/1974 Bomberger, Jr. et al.
4,309,226 A * 1/1982 Chen ..... C22F 1/183 148/407
4,889,170 A 12/1989 Mae et al.
5,472,526 A 12/1995 Gigliotti, Jr.
(Continued)

FOREIGN PATENT DOCUMENTS

CA 974095 A1 9/1975
CN 1954087 A 4/2007
(Continued)

OTHER PUBLICATIONS

ATI Ti—5Al—2Sn—2Zr—4Cr—4Mo Alloy Technical Datasheet (UNS R58650) ATI 17™, Version 1, Dec. 20, 2011, Allegheny Technologies Incorporated, 3 pages.
(Continued)

*Primary Examiner* — Sally A Merkling
*Assistant Examiner* — Ricardo D Morales
(74) *Attorney, Agent, or Firm* — Robert J. Toth; K&L Gates LLP

(57) ABSTRACT

A non-limiting embodiment of a titanium alloy comprises, in weight percentages based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities. A non-limiting embodiment of the titanium alloy comprises a zirconium-silicon-germanium intermetallic precipitate, and exhibits a steady-state creep rate less than $8\times10^{-4}$ $(24\ \text{hrs})^{-1}$ at a temperature of at least 890° F. under a load of 52 ksi.

26 Claims, 4 Drawing Sheets

(56) References Cited

U.S. PATENT DOCUMENTS

| | | | | |
|---|---|---|---|---|
| 6,800,243 | B2 | 10/2004 | Tetyukhin et al. | |
| 6,921,441 | B2 | 7/2005 | Tanaka et al. | |
| 7,008,489 | B2 | 3/2006 | Bania | |
| 7,083,687 | B2 | 8/2006 | Tanaka et al. | |
| 8,454,768 | B2 | 6/2013 | Fanning | |
| 10,023,942 | B2 | 7/2018 | Schutz et al. | |
| 2010/0326571 | A1* | 12/2010 | Deal | C22F 1/183 148/564 |
| 2016/0326612 | A1 | 11/2016 | Gudipati et al. | |
| 2018/0200766 | A1 | 7/2018 | Kunieda et al. | |
| 2020/0208241 | A1 | 7/2020 | Mantione et al. | |

FOREIGN PATENT DOCUMENTS

| | | | |
|---|---|---|---|
| CN | 101886189 | A | 11/2010 |
| EP | 1882752 | A2 | 1/2008 |
| GB | 888865 | | 2/1962 |
| JP | S62-267438 | A | 11/1987 |
| JP | H06-212378 | A | 8/1994 |
| JP | 2003-193159 | A | 7/2003 |
| JP | 2003-293051 | A | 10/2003 |
| JP | 2004-532785 | A | 10/2004 |
| JP | 2005-320570 | A | 11/2017 |
| RU | 1593259 | C | 11/1994 |
| RU | 2581332 | C2 | 4/2016 |
| SU | 524847 | A | 11/1976 |
| WO | WO 2016/114956 | A1 | 7/2016 |
| WO | WO 2017/018511 | A1 | 2/2017 |
| WO | WO 2017/018514 | A1 | 2/2017 |

OTHER PUBLICATIONS

Crossley et al., "Cast Transage 175 Titanium Alloy for Durability Critical Structural Components", Journal of Aircraft, vol. 20, No. 1, Jan. 1983, pp. 66-69.

Inagaki et al., "Application and Features of Titanium for the Aerospace Industry", Nippon Steel & Sumitomo Metal Technical Report, No. 106, Jul. 2014, pp. 22-27.

Nyakana, "Quick reference guide for beta titanium alloys in the 00s", JMEPEG, vol. 14, 2015, pp. 799-811.

Cotton et al., "State of the Art in Beta Titanium Alloys for Airframe Applications", JOM, vol. 67, No. 6, 2015, pp. 1281-1303.

Lütjering et al., Titanium, 2nd edition, Springer, 2007, pp. 264-269.

Materials Properties Handbook: Titanium Alloys, eds. Boyer et al., Materials Park, Ohio, ASM International, 1994, 13 pages.

Kansal et al., "Microstructural Banding in Thermally and Mechanically Processed Titanium 6242", Journal of Material Engineering and Performance, Springer Verlag, New York, US, vol. 1, No. 3, Jun. 1, 1992, pp. 393-398.

Kitashima et al., "Microstructure and Creep Properties of Silicon-and/or Germanium-Bearing Near-[alpha] Titanium Alloys", Materials Science Forum, vol. 879, Nov. 15, 2015, pp. 2324-2329.

U.S. Appl. No. 15/945,037, filed Apr. 4, 2018.

U.S. Appl. No. 15/972,319, filed May 7, 2018.

"Special Alloys and Forging Thereof," China Forging Association, pp. 119-122, National Defense Industry Press, Oct. 31, 2009.

"Metal Materials Science," Tang Daiming et al., pp. 251-252, Southwest Jiaotong University Press, Jun. 30, 2014.

"Engineering Materials and Metal Thermal Processing Basis," Jin Nanwei, p. 185, Aviation Industry Press, Jun. 30, 1995.

"Non-ferrous Metal Materials Science," Miao Qiang et al., p. 139, Northwestern Polytechnical University Press, Aug. 31, 2016.

Shipsha, V.G.,Titanium and Titanium Alloys, The Wayback Machine—https://web.archive.org/web/20180505165817/http://www.naukaspb.ru:80/spravochniki/Demo%20Metall/3_17.htm, accessed http://www.naukaspb.ru/spravochniki/Demo%20Metall/3_17.htm, May 5, 2018, 27 pages.

Effect of impurities on titanium alloys, accessed at https://supersplav.ru/blog/2017/05/23/vliyanie-prim+A14esei-na-titanovye-splavy/, May 23, 2017, 8 pages.

* cited by examiner

Zr/Si/Ge particle location indicated by black arrows and bright spot on the elemental maps. Ti/Al/Mo depletion indicated by black arrows and dark spot on elemental maps.

CREEP RESISTANT TITANIUM ALLOYS

BACKGROUND OF THE TECHNOLOGY

Field of the Technology

The present disclosure relates to creep resistant titanium alloys.

Description of the Background of the Technology

Titanium alloys typically exhibit a high strength-to-weight ratio, are corrosion resistant, and are resistant to creep at moderately high temperatures. For example, Ti-5Al-4Mo-4Cr-2Sn-2Zr alloy (also denoted "Ti-17 alloy," having a composition specified in UNS R58650) is a commercial alloy that is widely used for jet engine applications requiring a combination of high strength, fatigue resistance, and toughness at operating temperatures up to 800° F. Other examples of titanium alloys used for high temperature applications include Ti-6Al-2Sn-4Zr-2Mo alloy (having a composition specified in UNS R54620) and Ti-3Al-8V-6Cr-4Mo-4Zr alloy (also denoted "Beta-C", having a composition specified in UNS R58640). However, there are limits to creep resistance at elevated temperatures in these alloys. Accordingly, there has developed a need for titanium alloys having improved creep resistance at elevated temperatures.

SUMMARY

According to one non-limiting aspect of the present disclosure, a titanium alloy comprises, in percent by weight based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities.

According to another non-limiting aspect of the present disclosure, a titanium alloy consists essentially of, in weight percentages based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities.

According to another non-limiting aspect of the present disclosure, a titanium alloy comprises, in percent by weight based on total alloy weight: 2 to 7 aluminum; 0 to 5 tin; 0 to 5 molybdenum; 0.1 to 10.0 zirconium; 0.01 to 0.30 silicon; 0.05 to 2.0 germanium; 0 to 0.30 oxygen; 0 to 0.30 iron; 0 to 0.05 nitrogen; 0 to 0.05 carbon; 0 to 0.015 hydrogen; titanium; and impurities.

BRIEF DESCRIPTION OF THE DRAWINGS

The features and advantages of alloys, articles, and methods described herein may be better understood by reference to the accompanying drawings in which.

Figure 1:
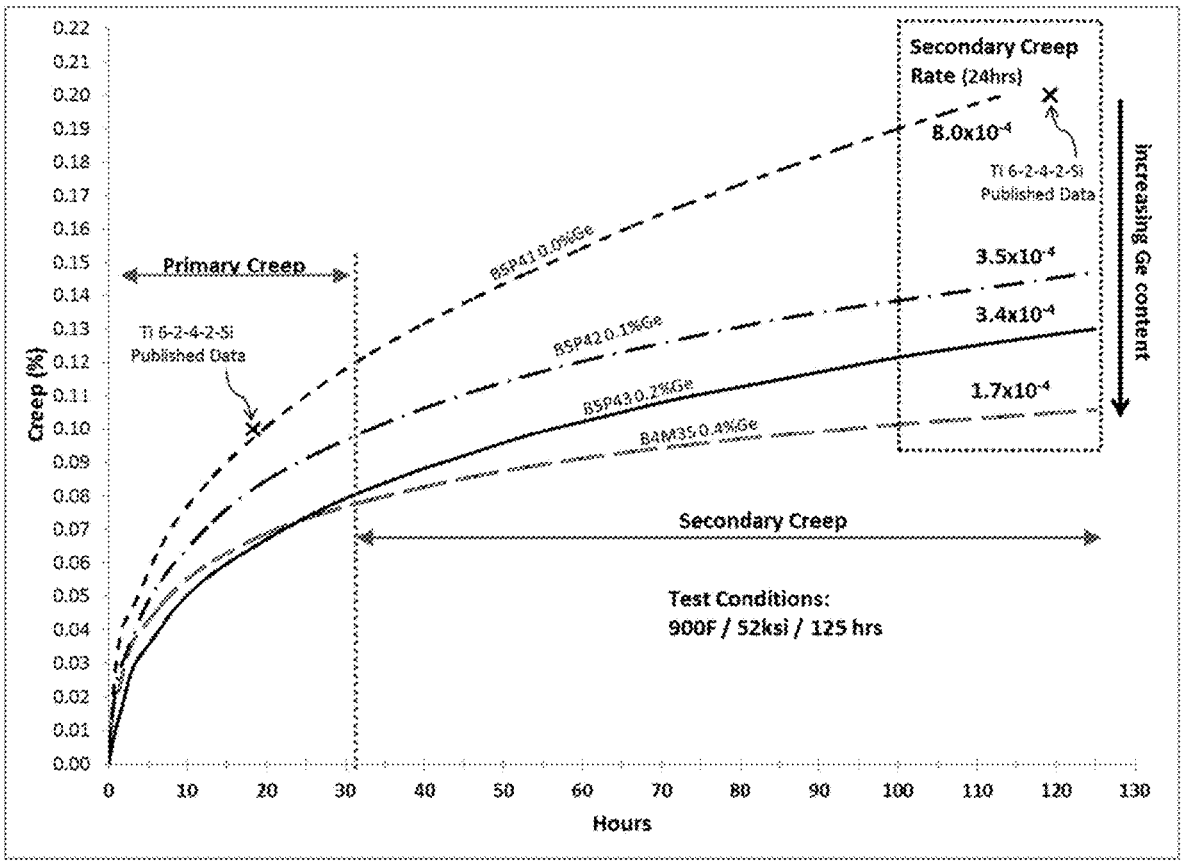
FIG. 1 is a graph plotting creep strain over time for certain non-limiting embodiments of titanium alloys according to the present disclosure in comparison to certain conventional titanium alloys.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the materials and by the methods according to the present disclosure. At the very least, and not as an attempt to limit the application of the doctrine of equivalents to the scope of the claims, each numerical parameter should at least be construed in light of the number of reported significant digits and by applying ordinary rounding techniques. All ranges described herein are inclusive of the described endpoints unless stated otherwise.

Any patent, publication, or other disclosure material that is said to be incorporated, in whole or in part, by reference herein is incorporated herein only to the extent that the incorporated material does not conflict with existing definitions, statements, or other disclosure material set forth in the present disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Reference herein to a titanium alloy "comprising" a particular composition is intended to encompass alloys "consisting essentially of" or "consisting of" the stated composition. It will be understood that titanium alloy compositions described herein "comprising", "consisting of", or "consisting essentially of" a particular composition also may include impurities.

Articles and parts in high temperature environments may suffer from creep. As used herein, "high temperature" refers to temperatures in excess of about 200° F. Creep is time-dependent strain occurring under stress. Creep occurring at a diminishing strain rate is referred to as primary creep; creep occurring at a minimum and almost constant strain rate is referred to as secondary (steady-state) creep; and creep occurring at an accelerating strain rate is referred to as tertiary creep. Creep strength is the stress that will cause a given creep strain in a creep test at a given time in a specified constant environment.

The creep resistance behavior of titanium and titanium alloys at high temperature and under a sustained load depends primarily on microstructural features. Titanium has two allotropic forms: a beta ("β")-phase, which has a body centered cubic ("bcc") crystal structure; and an alpha ("α")-phase, which has a hexagonal close packed ("hcp") crystal structure. In general, β titanium alloys exhibit poor elevated-temperature creep strength. The poor elevated-temperature creep strength is a result of the significant concentration of β phase these alloys exhibit at elevated temperatures such as, for example, 900° F. β phase does not resist creep well due to its body centered cubic structure, which provides for a large number of deformation mechanisms. As a result of these shortcomings, the use of β titanium alloys has been limited.

One group of titanium alloys widely used in a variety of applications is the α/β titanium alloy. In α/β titanium alloys, the distribution and size of the primary α particles can directly impact creep resistance. According to various published accounts of research on α/β titanium alloys containing silicon, the precipitation of silicides at the grain boundaries can further improve creep resistance, but to the detriment of room temperature tensile ductility. The reduction in room temperature tensile ductility that occurs with silicon addition limits the concentration of silicon that can be added, typically, to 0.3% (by weight).

The present disclosure, in part, is directed to alloys that address certain of the limitations of conventional titanium alloys. An embodiment of the titanium alloy according to the present disclosure includes (i.e., comprises), in percent by weight based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities. Another embodiment of the titanium alloy according to the present disclosure includes, in weight percentages based on total alloy weight: 5.5 to 6.5 aluminum; 1.7 to 2.1 tin; 1.7 to 2.1 molybdenum; 3.4 to 4.4 zirconium; 0.03 to 0.11 silicon; 0.1 to 0.4 germanium; titanium; and impurities. Yet another embodiment of the titanium alloy according to the present disclosure includes, in weight percentages based on total alloy weight: 5.9 to 6.0 aluminum; 1.9 to 2.0 tin; 1.8 to 1.9 molybdenum; 3.7 to 4.0 zirconium; 0.06 to 0.11 silicon; 0.1 to 0.4 germanium; titanium; and impurities. In non-limiting embodiments of alloys according to this disclosure, incidental elements and other impurities in the alloy composition may comprise or consist essentially of one or more of oxygen, iron, nitrogen, carbon, hydrogen, niobium, tungsten, vanadium, tantalum, manganese, nickel, hafnium, gallium, antimony, cobalt, and copper. Certain non-limiting embodiments of the titanium alloys according to the present disclosure may comprise, in weight percentages based on total alloy weight, 0.01 to 0.25 oxygen, 0 to 0.30 iron, 0.001 to 0.05 nitrogen, 0.001 to 0.05 carbon, 0 to 0.015 hydrogen, and 0 up to 0.1 of each of niobium, tungsten, hafnium, nickel, gallium, antimony, vanadium, tantalum, manganese, cobalt, and copper.

Aluminum may be included in the alloys according to the present disclosure to increase alpha content and provide increased strength. In certain non-limiting embodiments according to the present disclosure, aluminum may be present in weight concentrations, based on total alloy weight, of 2-7%. In certain non-limiting embodiments, aluminum may be present in weight concentrations, based on total alloy weight, of 5.5-6.5%, or in certain embodiments, 5.9-6.0%.

Tin may be included in the alloys according to the present disclosure to increase alpha content and provide increased strength. In certain non-limiting embodiments according to the present disclosure, tin may be present in weight concentrations, based on total alloy weight, of 0-4%. In certain non-limiting embodiments, tin may be present in weight concentrations, based on total alloy weight, of 1.5-2.5%, or in certain embodiments, 1.7-2.1%.

Molybdenum may be included in the alloys according to the present disclosure to increase beta content and provide increased strength. In certain non-limiting embodiments according to the present disclosure, molybdenum may be present in weight concentrations, based on total alloy weight, of 0-5%. In certain non-limiting embodiments, molybdenum may be present in weight concentrations, based on total alloy weight, of 1.3-2.3%, or in certain embodiments, 1.7-2.1%.

Zirconium may be included in the alloys according to the present disclosure to increase alpha content, provide increased strength and provide increased creep resistance by forming an intermetallic precipitate. In certain non-limiting embodiments according to the present disclosure, zirconium may be present in weight concentrations, based on total alloy weight, of 1-10%. In certain non-limiting embodiments, zirconium may be present in weight concentrations, based on total alloy weight, of 3.4-4.4%, or in certain embodiments, 3.5-4.3%.

Silicon may be included in the alloys according to the present disclosure to provide increased creep resistance by forming an intermetallic precipitate. In certain non-limiting embodiments according to the present disclosure, silicon may be present in weight concentrations, based on total alloy weight, of 0.01-0.30%. In certain non-limiting embodiments, silicon may be present in weight concentrations, based on total alloy weight, of 0.03-0.11%, or in certain embodiments, 0.06-0.11%.

Germanium may be included in embodiments of titanium alloys according to the present disclosure to improve secondary creep rate behavior at elevated temperatures. In certain non-limiting embodiments according to the present disclosure, germanium may be present in weight concentrations, based on total alloy weight, of 0.05-2.0%. In certain non-limiting embodiments, germanium may be present in weight concentrations, based on total alloy weight, of 0.1-2.0%, or in certain embodiments, 0.1-0.4%. Without intending to be bound to any theory, it is believed that the germanium content of the alloys in conjunction with a suitable heat treatment may promote precipitation of a zirconium-silicon-germanium intermetallic precipitate. The germanium additions can be by, for example, pure metal or a master alloy of germanium and one or more other suitable metallic elements. Si—Ge and Al—Ge may be suitable examples of master alloys. Certain master alloys may be in powder, pellets, wire, crushed chips, or sheet form. The titanium alloys described herein are not limited in this regard. After final melting to achieve a substantially homogeneous mixture of titanium and alloying elements, the cast ingot can be thermo-mechanically worked through one or more steps of forging, rolling, extruding, drawing, swaging, upsetting, and annealing to achieve the desired microstructure. It is to be understood that the alloys of the present disclosure may be thermo-mechanically worked and/or treated by other suitable methods.

A non-limiting embodiment of a method of making a titanium alloy according to the present disclosure comprises heat treating by annealing, solution treating and annealing, solution treating and aging (STA), direct aging, or a combination a thermal cycles to obtained the desired balance of mechanical properties. As used herein, a "solution treating and aging (STA)" process refers to a heat treating process applied to titanium alloys that includes solution treating a titanium alloy at a solution treating temperature below the β-transus temperature of the titanium alloy. In a non-limiting embodiment, the solution treating temperature is in a temperature range from about 1780° F. to about 1800° F. The solution treated alloy is subsequently aged by heating the alloy for a period of time to an aging temperature range that is less than the β-transus temperature and less than the solution treating temperature of the titanium alloy. As used herein, terms such as "heated to" or "heating to," etc., with reference to a temperature, a temperature range, or a minimum temperature, mean that the alloy is heated until at least the desired portion of the alloy has a temperature at least equal to the referenced or minimum temperature, or within the referenced temperature range throughout the portion's extent. In a non-limiting embodiment, a solution treatment time ranges from about 30 minutes to about 4 hours. It is recognized that in certain non-limiting embodiments, the solution treatment time may be shorter than 30 minutes or longer than 4 hours and is generally dependent upon the size and cross-section of the titanium alloy. Upon completion of the solution treatment, the titanium alloy is cooled to ambient temperature at a rate depending on a cross-sectional thickness of the titanium alloy.

The solution treated titanium alloy is subsequently aged at an aging temperature, also referred to herein as an "age hardening temperature", that is in the $\alpha+\beta$ two-phase field below the $\beta$ transus temperature of the titanium alloy. In a non-limiting embodiment, the aging temperature is in a temperature range from about 1075° F. to about 1125° F. In certain non-limiting embodiments, the aging time may range from about 30 minutes to about 8 hours. It is recognized that in certain non-limiting embodiments, the aging time may be shorter than 30 minutes or longer than 8 hours and is generally dependent upon the size and cross-section of the titanium alloy product form. General techniques used in STA processing of titanium alloys are known to practitioners of ordinary skill in the art and, therefore, are not further discussed herein.

While it is recognized that the mechanical properties of titanium alloys are generally influenced by the size of the specimen being tested, in certain non-limiting embodiments of the titanium alloy according to the present disclosure, the titanium alloy exhibits a steady-state (also known as secondary or "stage II") creep rate less than $8\times10^{-4}$ (24 hrs)$^{-1}$ at a temperature of at least 890° F. under a load of 52 ksi. Also, for example, certain non-limiting embodiments of titanium alloys according to the present disclosure may exhibit a steady-state (secondary or stage II) creep rate less than $8\times10^{-4}$ (24 hrs)$^{-1}$ at a temperature of 900° F. under a load of 52 ksi. In certain non-limiting embodiments according to the present disclosure, the titanium alloy exhibits an ultimate tensile strength of at least 130 ksi at 900° F. In other non-limiting embodiments, a titanium alloy according to the present disclosure exhibits a time to 0.1% creep strain of no less than 20 hours at 900° F. under a load of 52 ksi.

The examples that follow are intended to further describe non-limiting embodiments according to the present disclosure, without restricting the scope of the present invention. Persons having ordinary skill in the art will appreciate that variations of the following examples are possible within the scope of the invention, which is defined solely by the claims.

EXAMPLE 1

Table 1 lists elemental compositions of certain non-limiting embodiments of titanium alloys according to the present disclosure ("Experimental Titanium Alloy No. 1," "Experimental Titanium Alloy No. 2," and "Experimental Titanium Alloy No. 3"), along with a comparative titanium alloy that does not include an intentional addition of germanium ("Comparative Titanium Alloy").

TABLE 1

| Alloy | Al (wt %) | Sn (wt %) | Zr (wt %) | Mo (wt %) | Si (wt %) | O (wt %) | Ge (wt %) | C (wt %) | N (wt %) |
|---|---|---|---|---|---|---|---|---|---|
| Comparative Titanium Alloy, UNS R58650 (B5P41) | 5.9 | 1.8 | 4.1 | 1.9 | 0.07 | 0.16 | 0.0 | 0.013 | 0.001 |
| Experimental Titanium Alloy No. 1 (B5P42) | 5.9 | 1.9 | 4.0 | 1.8 | 0.06 | 0.12 | 0.1 | 0.003 | 0.001 |
| Experimental Titanium Alloy No. 2 (B5P43) | 5.9 | 1.9 | 3.9 | 1.9 | 0.07 | 0.13 | 0.2 | 0.003 | 0.001 |
| Experimental Titanium Alloy No. 3 (B4M35) | 6.0 | 2.0 | 3.7 | 1.8 | 0.11 | 0.13 | 0.4 | 0.008 | 0.001 |

Plasma arc melt (PAM) heats of the Comparative Titanium Alloy, Experimental Titanium Alloy No. 1, Experimental Titanium Alloy No. 2, and Experimental Titanium Alloy No. 3 listed in Table 1 were produced using plasma arc furnaces to produce 9 inch diameter electrodes, each weighing approximately 400-800 lb. The electrodes were remelted in a vacuum arc remelt (VAR) furnace to produce 10 inch diameter ingots. Each ingot was converted to a 3 inch diameter billet using a hot working press. After a 13 forging step to 7 inch diameter, an $\alpha+\beta$ prestrain forging step to 5 inch diameter, and a $\beta$ finish forging step to 3 inch diameter, the ends of each billet were cropped to remove suck-in and end-cracks, and the billets were cut into multiple pieces. The top of each billet and the bottom of the bottom-most billet at 7 inch diameter were sampled for chemistry and $\beta$ transus. Based on the intermediate billet chemistry results, 2 inch long samples were cut from the billets and "pancake"-forged on the press. The pancake specimens were heat treated to a solution treated and aged condition as follows: solution treating the titanium alloy at 1780° F. to 1800° F. for 4 hours; cooling the titanium alloy to ambient temperature at a rate depending on a cross-sectional thickness of the titanium alloy; aging the titanium alloy at 1025° F. to 1125° F. for 8 hours; and air cooling the titanium alloy.

Test blanks for room and high temperature tensile tests, creep tests, fracture toughness, and microstructure analysis were cut from the STA processed pancake specimens. A final chemistry analysis was performed on the fracture toughness coupon after testing to ensure accurate correlation between chemistry and mechanical properties. Certain mechanical properties of the experimental titanium alloys listed in Table 1 were measured and compared to that of the comparative titanium alloy listed in Table 1. The results are listed in Table 2. The tensile tests were conducted according to the American Society for Testing and Materials (ASTM) standard E8/E8M-09 ("Standard Test Methods for Tension Testing of Metallic Materials", ASTM International, 2009). As shown by the results listed in Table 2, the experimental titanium alloy samples exhibited ultimate tensile strength and yield strength at room temperature comparable to the comparative titanium alloy, which did not include an intentional addition of germanium.

TABLE 2

| Alloy | Heat Treatment | Room Temperature (72° F.) UTS (ksi) | YS (ksi) | % el | % RA | Elevated Temperature (900° F.) UTS (ksi) | YS (ksi) | % el | % RA |
|---|---|---|---|---|---|---|---|---|---|
| Comparative Titanium Alloy, UNS R58650 (B5P41) | 1 | 178 | 163 | 13 | 45 | 125 | 109 | 17 | 63 |
| Experimental Titanium Alloy No. 1 (B5P42) | 1 | 175 | 157 | 13 | 39 | 130 | 103 | 18 | 64 |
| Experimental Titanium Alloy No. 2 (B5P43) | 1 | 178 | 157 | 14 | 39 | 130 | 95 | 17 | 59 |
| Experimental Titanium Alloy No. 3 (B4M35) | 2 | 177 | 158 | 6 | 12 | 133 | 106 | 13 | 41 |

Figure 2:
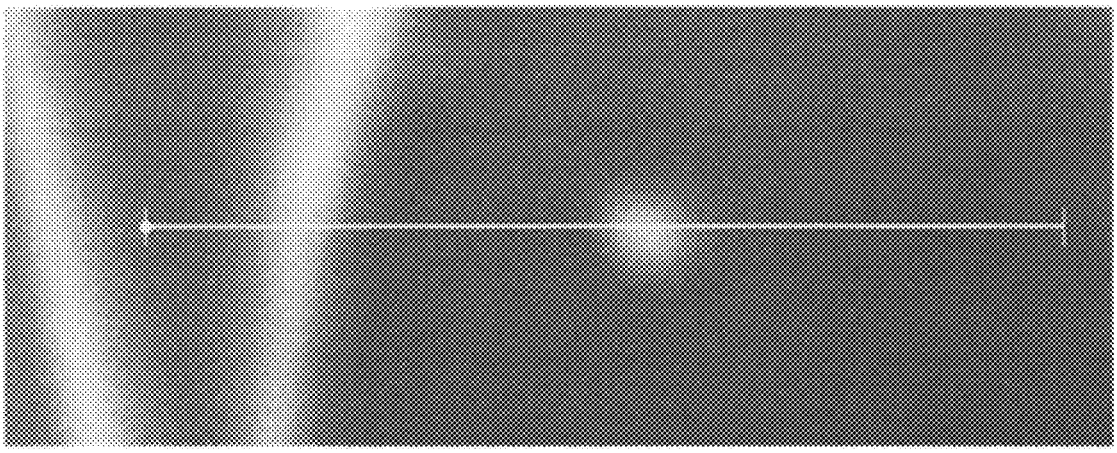
FIG. 2 includes a micrograph of a non-limiting embodiment of a titanium alloy according to the present disclosure, and a graph showing results of an energy dispersive X-ray (XRD) scan of the alloy prior to sustained load exposure.
Figure 2:
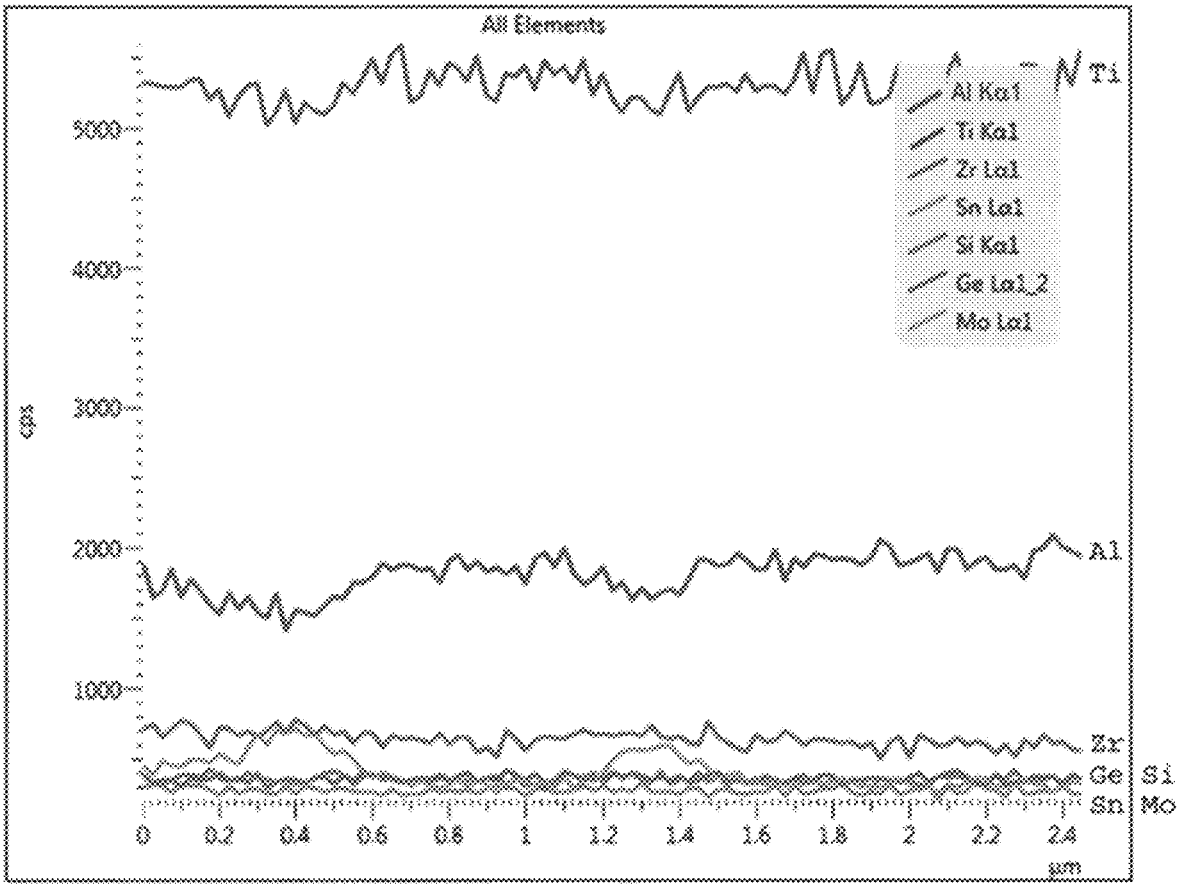
Figure 3:
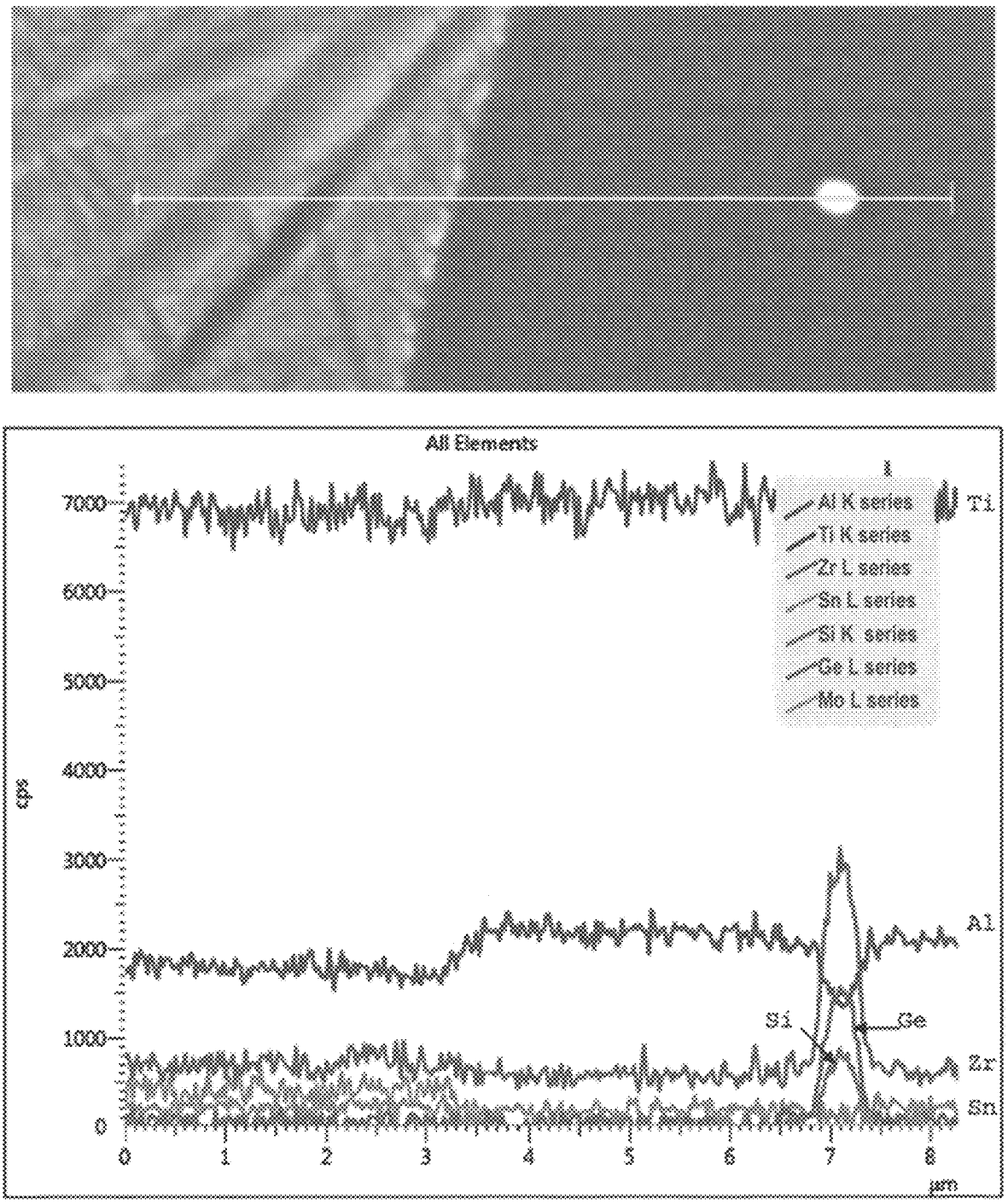
FIG. 3 includes a micrograph of the titanium alloy of FIG. 2, and a graph showing results of an XRD scan of the alloy and the partitioning of Zr/Si/Ge to an intermetallic precipitate after the alloy was heated at 900° F. for 125 hours under a sustained load of 52 ksi.
Figure 4:
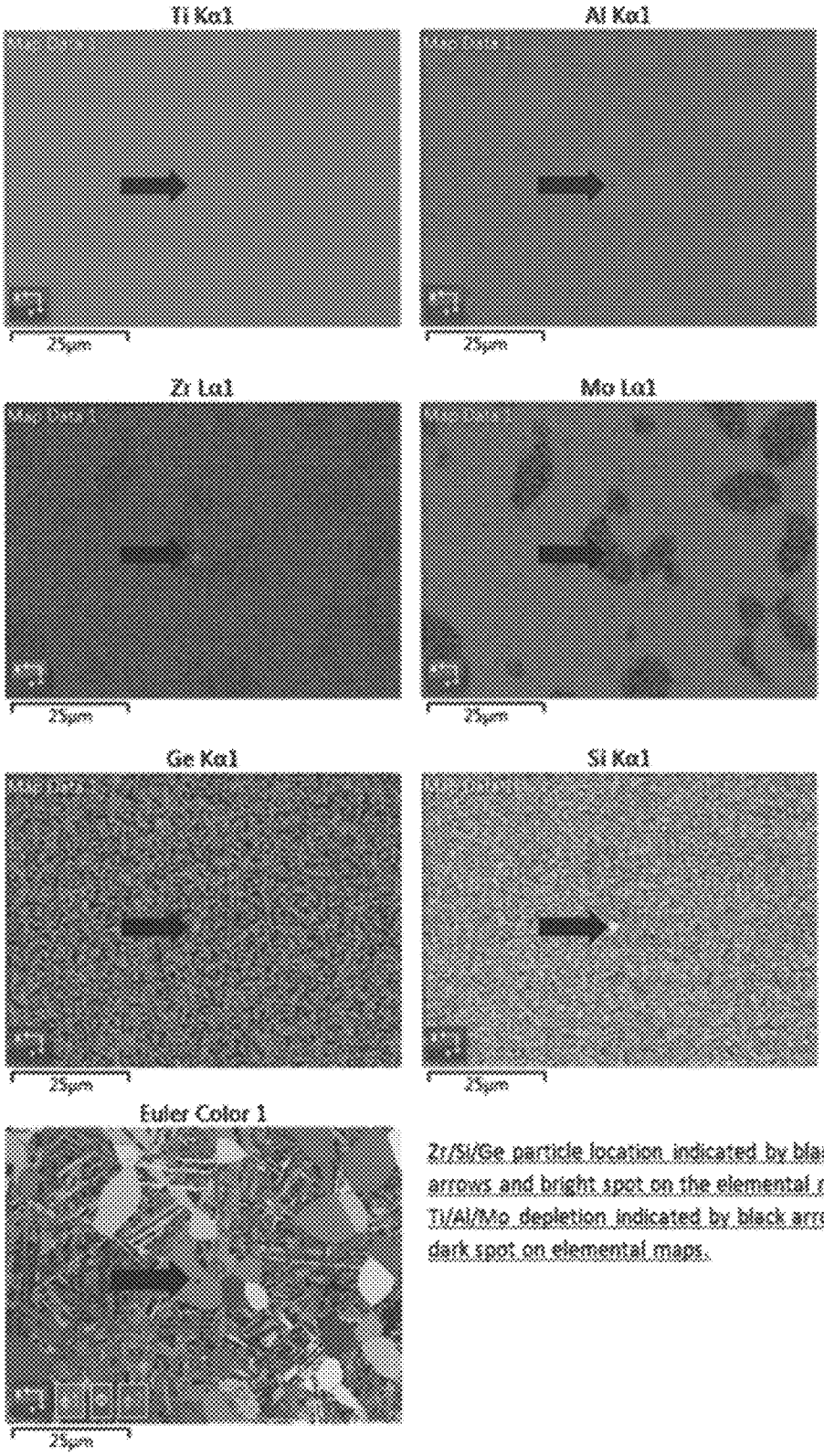
FIG. 4 shows elemental maps for the titanium alloy of FIG. 3.

Heat Treatments:
1 - Solution treating at 17854° F. for 4 hours, water quenching, aging at 1100° F. for 8 hours, and air cooling
2 - Solution treating at 1800° F. for 4 hours, water quenching, aging at 1100° F. for 8 hours, and air cooling Creep-rupture tests according to ASTM E139 were conducted on the alloys listed in Table 1. The results are presented in FIG. 1. The experimental titanium alloys of the present disclosure exhibited very favorable secondary creep rates relative to the comparative titanium alloy. Referring to FIGS. 2-4, precipitation of a zirconium-silicon-germanium intermetallic phase was detected in Experimental Titanium Alloy No. 2 after creep exposure to a sustained load and elevated temperature in excess of the time for primary (or stage I) creep. As shown by FIG. 1, the experimental titanium alloy samples of the present disclosure exhibited steady-state creep after approximately 30 hours at 900° F. under a load of 52 ksi. The Comparative Titanium Alloy exhibited a time to 0.1% creep strain of 19.4 hours at 900° F. under a load of 52 ksi. Experimental Titanium Alloy No. 1, Experimental Titanium Alloy No. 2, and Experimental Titanium Alloy No. 3 all exhibited a significantly greater time to 0.1% creep strain at 900° F. under a load of 52 ksi: 32.6 hours, 55.3 hours, and 93.3 hours, respectively.

Samples examined prior to the creep exposure (but after the heat treatments) did not reveal the presence of intermetallic precipitates. Referring to FIG. 2, an elemental scan by energy dispersive x-rays (EDS) of Experimental Titanium Alloy No. 2 prior to creep exposure showed a substantially uniform distribution of germanium in the $\alpha/\beta$ microstructure without the intermetallic particles. In FIGS. 3-4, partitioning of zirconium, silicon, and germanium to intermetallic particles is visible after the creep exposure. The intermetallic particles generally exhibit depletion of aluminum relative to the surrounding alpha particle. The precipitation of the intermetallic particles after the creep exposure was particularly unexpected and surprising. Without intending to be bound to any theory, it is believed that the intermetallic particles may improve secondary creep for the alloys without substantially impacting high temperature yield strength.

The potential uses of alloys according to the present disclosure are numerous. As described and evidenced above, the titanium alloys described herein are advantageously used in a variety of applications in which creep resistance at elevated temperatures is important. Articles of manufacture for which the titanium alloys according to the present disclosure would be particularly advantageous include certain aerospace and aeronautical applications including, for example, jet engine turbine discs and turbofan blades. Those having ordinary skill in the art will be capable of fabricating the foregoing equipment, parts, and other articles of manufacture from alloys according to the present disclosure without the need to provide further description herein. The foregoing examples of possible applications for alloys according to the present disclosure are offered by way of example only, and are not exhaustive of all applications in which the present alloy product forms may be applied. Those having ordinary skill, upon reading the present disclosure, may readily identify additional applications for the alloys as described herein.

Various non-exhaustive, non-limiting aspects of novel alloys and methods according to the present disclosure may be useful alone or in combination with one or more other aspect described herein. Without limiting the foregoing description, in a first non-limiting aspect of the present disclosure, a titanium alloy comprises, in percent by weight based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities.

In accordance with a second non-limiting aspect of the present disclosure, which may be used in combination with the first aspect, the titanium alloy comprises, in weight percentages based on total alloy weight: 5.5 to 6.5 aluminum; 1.7 to 2.1 tin; 1.7 to 2.1 molybdenum; 3.4 to 4.4 zirconium; 0.03 to 0.11 silicon; 0.1 to 0.4 germanium; titanium; and impurities.

In accordance with a third non-limiting aspect of the present disclosure, which may be used in combination with each or any of the above-mentioned aspects, the titanium alloy comprises, in weight percentages based on total alloy weight: 5.9 to 6.0 aluminum; 1.9 to 2.0 tin; 1.8 to 1.9 molybdenum; 3.5 to 4.3 zirconium; 0.06 to 0.11 silicon; 0.1 to 0.4 germanium; titanium; and impurities.

In accordance with a fourth non-limiting aspect of the present disclosure, which may be used in combination with each or any of the above-mentioned aspects, the titanium alloy further comprises, in weight percentages based on total alloy weight: 0 to 0.30 oxygen; 0 to 0.30 iron; 0 to 0.05 nitrogen; 0 to 0.05 carbon; 0 to 0.015 hydrogen; and 0 to 0.1 each of niobium, tungsten, hafnium, nickel, gallium, antimony, vanadium, tantalum, manganese, cobalt, and copper.

In accordance with a fifth non-limiting aspect of the present disclosure, which may be used in combination with each or any of the above-mentioned aspects, the titanium alloy comprises a zirconium-silicon-germanium intermetallic precipitate.

In accordance with a sixth non-limiting aspect of the present disclosure, which may be used in combination with each or any of the above-mentioned aspects, the titanium alloy exhibits a steady-state creep rate less than $8\times10^{-4}$ (24 hrs)$^{-1}$ at a temperature of at least 890° F. under a load of 52 ksi.

In accordance with a seventh non-limiting aspect of the present disclosure, a method of making a titanium alloy comprises: solution treating the titanium alloy at 1780° F. to 1800° F. for 4 hours; cooling the titanium alloy to ambient temperature at a rate depending on a cross-sectional thickness of the titanium alloy; aging the titanium alloy at 1025° F. to 1125° F. for 8 hours; and air cooling the titanium alloy, wherein the titanium alloy has the composition recited in each or any of the above-mentioned aspects.

In accordance with an eighth non-limiting aspect of the present disclosure, which may be used in combination with each or any of the above-mentioned aspects, the titanium alloy exhibits an ultimate tensile strength of at least 130 ksi at 900° F.

In accordance with a ninth non-limiting aspect of the present disclosure, the present disclosure also provides a titanium alloy consisting essentially of, in weight percentages based on total alloy weight: 5.5 to 6.5 aluminum; 1.5 to 2.5 tin; 1.3 to 2.3 molybdenum; 0.1 to 10.0 zirconium; 0.01 to 0.30 silicon; 0.1 to 2.0 germanium; titanium; and impurities.

In accordance with a tenth non-limiting aspect of the present disclosure, which may be used in combination with each or any of the above-mentioned aspects, an aluminum content in the alloy is, in weight percentages based on total alloy weight, 5.9 to 6.0.

In accordance with an eleventh non-limiting aspect of the present disclosure, which may be used in combination with each or any of the above-mentioned aspects, a tin content in the alloy is, in weight percentages based on total alloy weight, 1.7 to 2.1.

In accordance with a twelfth non-limiting aspect of the present disclosure, which may be used in combination with each or any of the above-mentioned aspects, a tin content in the alloy is, in weight percentages based on total alloy weight, 1.9 to 2.0.

In accordance with a thirteenth non-limiting aspect of the present disclosure, which may be used in combination with each or any of the above-mentioned aspects, a molybdenum content in the alloy is, in weight percentages based on total alloy weight, 1.7 to 2.1.

In accordance with a fourteenth non-limiting aspect of the present disclosure, which may be used in combination with each or any of the above-mentioned aspects, a molybdenum content in the alloy is, in weight percentages based on total alloy weight, 1.8 to 1.9.

In accordance with a fifteenth non-limiting aspect of the present disclosure, which may be used in combination with each or any of the above-mentioned aspects, a zirconium content in the alloy is, in weight percentages based on total alloy weight, 3.4 to 4.4.

In accordance with a sixteenth non-limiting aspect of the present disclosure, which may be used in combination with each or any of the above-mentioned aspects, a zirconium content in the alloy is, in weight percentages based on total alloy weight, 3.5 to 4.3.

In accordance with a seventeenth non-limiting aspect of the present disclosure, which may be used in combination with each or any of the above-mentioned aspects, a silicon content in the alloy is, in weight percentages based on total alloy weight, 0.03 to 0.11.

In accordance with an eighteenth non-limiting aspect of the present disclosure, which may be used in combination with each or any of the above-mentioned aspects, a silicon content in the alloy is, in weight percentages based on total alloy weight, 0.06 to 0.11.

In accordance with a nineteenth non-limiting aspect of the present disclosure, which may be used in combination with each or any of the above-mentioned aspects, a germanium content in the alloy is, in weight percentages based on total alloy weight, 0.1 to 0.4.

In accordance with a twentieth non-limiting aspect of the present disclosure, which may be used in combination with each or any of the above-mentioned aspects, in the titanium alloy: an oxygen content is 0 to 0.30; an iron content is 0 to 0.30; a nitrogen content is 0 to 0.05; a carbon content is 0 to 0.05; a hydrogen content is 0 to 0.015; and a content of each of niobium, tungsten, hafnium, nickel, gallium, antimony, vanadium, tantalum, manganese, cobalt, and copper is 0 to 0.1, all in weight percentages based on total weight of the titanium alloy.

In accordance with a twenty-first non-limiting aspect of the present disclosure, which may be used in combination with each or any of the above-mentioned aspects, a method of making a titanium alloy comprises: solution treating a titanium alloy at 1780° F. to 1800° F. for 4 hours; cooling the titanium alloy to ambient temperature at a rate depending on a cross-sectional thickness of the titanium alloy; aging the titanium alloy at 1025° F. to 1125° F. for 8 hours; and air cooling the titanium alloy, wherein the titanium alloy has the composition recited in each or any of the above-mentioned aspects.

In accordance with a twenty-second non-limiting aspect of the present disclosure, which may be used in combination with each or any of the above-mentioned aspects, the titanium alloy exhibits a steady-state creep rate less than $8\times10^{-4}$ (24 hrs)$^{-1}$ at a temperature of at least 890° F. under a load of 52 ksi.

In accordance with a twenty-third non-limiting aspect of the present disclosure, which may be used in combination with each or any of the above-mentioned aspects, the titanium alloy exhibits an ultimate tensile strength of at least 130 ksi at 900° F.

In accordance with a twenty-fourth non-limiting aspect of the present disclosure, the present disclosure also provides a titanium alloy comprising, in weight percentages based on total alloy weight: 2 to 7 aluminum; 0 to 5 tin; 0 to 5 molybdenum; 0.1 to 10.0 zirconium; 0.01 to 0.30 silicon; 0.05 to 2.0 germanium; 0 to 0.30 oxygen; 0 to 0.30 iron; 0 to 0.05 nitrogen; 0 to 0.05 carbon; 0 to 0.015 hydrogen; titanium; and impurities.

In accordance with a twenty-fifth non-limiting aspect of the present disclosure, which may be used in combination with each or any of the above-mentioned aspects, the titanium alloy exhibits a steady-state creep rate less than $8\times10^{-4}$ (24 hrs)$^{-1}$ at a temperature of at least 890° F. under a load of 52 ksi.

In accordance with a twenty-sixth non-limiting aspect of the present disclosure, which may be used in combination with each or any of the above-mentioned aspects, the titanium alloy further comprises, in weight percentages based on total alloy weight: 0 to 5 chromium.

In accordance with a twenty-seventh non-limiting aspect of the present disclosure, which may be used in combination with each or any of the above-mentioned aspects, the titanium alloy further comprises, in weight percentages based on total alloy weight: 0 to 6.0 each of niobium, tungsten, vanadium, tantalum, manganese, nickel, hafnium, gallium, antimony, cobalt, and copper.

In accordance with a twenty-eighth non-limiting aspect of the present disclosure, which may be used in combination with each or any of the above-mentioned aspects, the titanium alloy exhibits a steady-state creep rate less than $8\times10^{-4}$ (24 hrs)$^{-1}$ at a temperature of at least 890° F. under a load of 52 ksi.

In accordance with a twenty-ninth non-limiting aspect of the present disclosure, which may be used in combination with each or any of the above-mentioned aspects, the titanium alloy further comprises, in weight percentages based on total alloy weight: 0 to 5 chromium.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A titanium alloy comprising, in weight percentages based on total alloy weight:
- 5.5 to 6.5 aluminum;
- 1.5 to 2.5 tin;
- 1.3 to 2.3 molybdenum;
- 0.1 to 10.0 zirconium;
- 0.01 to 0.30 silicon;
- 0.1 to 2.0 germanium;
- titanium; and
- impurities;
- wherein the titanium alloy comprises an intermetallic precipitate comprising zirconium, silicon, and germanium.

2. The titanium alloy of claim 1 comprising, in weight percentages based on total alloy weight:
- 5.5 to 6.5 aluminum;
- 1.7 to 2.1 tin;
- 1.7 to 2.1 molybdenum;
- 3.4 to 4.4 zirconium;
- 0.03 to 0.11 silicon;
- 0.1 to 0.4 germanium;
- titanium; and
- impurities.

3. The titanium alloy of claim 1 comprising, in weight percentages based on total alloy weight:
- 5.9 to 6.0 aluminum;
- 1.9 to 2.0 tin;
- 1.8 to 1.9 molybdenum;
- 3.5 to 4.3 zirconium;
- 0.06 to 0.11 silicon;
- 0.1 to 0.4 germanium;
- titanium; and
- impurities.

4. The titanium alloy of claim 1 further comprising, in weight percentages based on total alloy weight:
- 0 to 0.15 oxygen;
- 0 to 0.30 iron;
- 0 to 0.05 nitrogen;
- 0 to 0.05 carbon;
- 0 to 0.015 hydrogen; and
- 0 to 0.1 each of niobium, tungsten, hafnium, nickel, gallium, antimony, vanadium, tantalum, manganese, cobalt, and copper.

5. The titanium alloy of claim 1, wherein the titanium alloy exhibits a steady-state creep rate less than $7.97\times10^{-4}$ (24 hrs)$^{-1}$ at a temperature of at least 475° C. under a load of 52 ksi.

6. The titanium alloy of claim 1, wherein the titanium alloy exhibits an ultimate tensile strength of at least 130 ksi at 482° C.

7. A titanium alloy consisting essentially of, in weight percentages based on total alloy weight:
- 5.5 to 6.5 aluminum;
- 1.5 to 2.5 tin;
- 1.3 to 2.3 molybdenum;
- 0.1 to 10.0 zirconium;
- 0.01 to 0.30 silicon;
- 0.1 to 2.0 germanium;
- 0 to 0.15 oxygen;
- 0 to 0.30 iron;
- 0 to 0.05 nitrogen;
- 0 to 0.05 carbon;
- 0 to 0.015 hydrogen;
- 0 to 0.1 of each of niobium, tungsten; hafnium, nickel, gallium, antimony, vanadium, tantalum, manganese, cobalt; and copper;
- titanium; and
- impurities,
- wherein the titanium alloy comprises an intermetallic precipitate comprising zirconium, silicon, and germanium.

8. The titanium alloy of claim 7, wherein an aluminum content in the alloy is, in weight percentages based on total alloy weight, 5.9 to 6.0.

9. The titanium alloy of claim 7, wherein a tin content in the alloy is, in weight percentages based on total alloy weight, 1.7 to 2.1.

10. The titanium ahoy of claim 7; wherein a tin content in the alloy is, in weight percentages based on total alloy weight, 1.9 to 2.0.

11. The titanium alloy of claim 7, wherein a molybdenum content in the alloy is, in weight percentages based on total alloy weight, 1.7 to 2.1.

12. The titanium alloy of claim 7, wherein a molybdenum content in the alloy is, in weight percentages based on total alloy weight, 1.8 to 1.9.

13. The titanium alloy of claim 7, wherein a zirconium content in the alloy is, in weight percentages based on total alloy weight, 3.4 to 4.4.

14. The titanium alloy of claim 7, wherein a zirconium content in the alloy is, in weight percentages based on total alloy weight, 3.5 to 4.3.

15. The titanium alloy of claim 7, wherein a silicon content in the alloy is, in weight percentages based on total alloy weight, 0.03 to 0.11.

16. The titanium alloy of claim 7, wherein a silicon content in the alloy is, in weight percentages based on total alloy weight, 0.06 to 0.11.

17. The titanium alloy of claim 7, wherein a germanium content n the alloy is, in weight percentages based on total alloy weight, 0.1 to 0.4.

18. The titanium alloy of claim 7; wherein in the titanium alloy;

an oxygen content is 0 to 0.15;

an iron content is 0 to 0.30;

a nitrogen content is 0 to 0.05;

a carbon content is 0 to 0.05;

a hydrogen content is 0 to 0.015; and a content of each of niobium, tungsten, hafnium, nickel, gallium, antimony, vanadium, tantalum, manganese, cobalt, and copper is 0 to 0.1, all in weight percentages based on total weight of the titanium alloy.

19. The titanium alloy of claim 7, wherein the titanium alloy exhibits a steady-state creep rate less than $7.97\times10^{-4}$ $(24\ \text{hrs})^{-1}$ at a temperature of at least 475° C. under a load of 52 ksi.

20. The titanium alloy of claim 7, wherein the titanium alloy exhibits an ultimate tensile strength of at least 130 ksi at 482° C.

21. A titanium alloy comprising, in weight percentages based on total alloy weight:

2 to 7 aluminum;

0 to 5 tin;

0 to 5 molybdenum;

0.1 to 10.0 zirconium;

0.01 to 0.30 silicon;

0.05 to 2.0 germanium;

0 to 0.30 oxygen;

0 to 0.30 iron;

0 to 0.05 nitrogen;

0 to 0.05 carbon;

0 to 0.015 hydrogen;

titanium; and impurities;

wherein the titanium ahoy comprises an intermetallic precipitate comprising zirconium, silicon, and germanium.

22. The titanium alloy of claim 21, wherein the titanium alloy exhibits a steady-state creep rate less than $8\times10^{-4}$ $(24\ \text{hrs})^{-1}$ at a temperature of at least 890° F. under a load of 52 ksi.

23. The titanium alloy of claim 21 further comprising, in weight percentages based on total alloy weight:

0 to 5 chromium.

24. The titanium alloy of claim 21 further comprising, in weight percentages based on total alloy weight:

0 to 6.0 each of niobium, tungsten, vanadium, tantalum, manganese, nickel, hafnium, gallium, antimony, cobalt, and copper.

25. The titanium alloy of claim 24, wherein the titanium alloy exhibits a steady-state creep rate less than $8\times10^{-4}$ $(24\ \text{hrs})^{-1}$ at a temperature of at least 890° F. under a load of 52 ksi.

26. The titanium alloy of claim 24 further comprising, in weight percentages based on total alloy weight:

0 to 5 chromium.

* * * * *